United States Patent [19]

Mudge et al.

[11] Patent Number: 4,610,920

[45] Date of Patent: Sep. 9, 1986

[54] BINDERS FOR NONWOVENS

[75] Inventors: Paul R. Mudge, Somerville; Howard G. Katz, Hightstown, both of N.J.

[73] Assignee: National Starch and Chemical Corporation, Bridgewater, N.J.

[21] Appl. No.: 749,208

[22] Filed: Jun. 27, 1985

[51] Int. Cl.[4] ..... B32B 27/00

[52] U.S. Cl. ..... 428/288; 427/391; 427/392; 427/394; 428/290; 524/502

[58] Field of Search ..... 428/288, 290; 524/502; 427/391, 392, 394

[56] References Cited

U.S. PATENT DOCUMENTS 3,337,482 8/1967 Watanabe et al. ..... 260/8
3,380,851 4/1968 Lindemann et al. ..... 117/140
4,044,197 8/1977 Wiest et al. ..... 210/2
4,073,779 2/1978 Wiest et al. ..... 260/79.3
4,322,516 3/1982 Wiest et al. ..... 210/2

*Primary Examiner*—Marion C. McCamish
*Attorney, Agent, or Firm*—Ellen T. Dec; Edwin M. Szala

[57] ABSTRACT

Nonwoven fabrics characterized by a superior balance of strength and softness are formed utilizing an aqueous emulsion prepared by the emulsion polymerization of: 30 to 50% by weight of vinyl ester of an alkanoic acid; 10 to 30% by weight ethylene; 30 to 50% by weight of $C_4$–$C_8$ alkyl acrylate; and 1 to 5% by weight of copolymerizable N-methylol containing monomer; wherein the polymerization is performed using batch or semi-batch techniques.

20 Claims, 2 Drawing Figures

BINDERS FOR NONWOVENS

BACKGROUND OF THE INVENTION

Nonwoven fabrics, or nonwovens, have gained great acceptance in the industry for a wide range of applications, particularly as replacements for woven fabrics in constructions such as for facings or topsheets in diapers, incontinent pads, bed pads, sanitary napkins, hospital gowns, and other single and multi-use nonwovens. For such uses it is desirable to produce a nonwoven which closely resembles the drape, flexibility and softness (hand) of a textile and yet is as strong as possible.

When an adhesive binder is used to bond the loosely assembled webs of fibers in the nonwoven, the particular binder employed plays an important role in determining the final properties of the nonwoven since it contributes to the presence or absence of a wide range of properties including the wet and dry tensile, tear strength, softness, absorbency, and resilience as well as the visual aesthetics. Acrylic latices have generally been used as binders where softness is the most important criteria, however the resultant nonwovens have suffered in strength. Ethylene/vinyl acetate-based binders yield the necessary strength properties but are deficient in softness for some applications requiring extreme softness. Efforts have been made to soften the ethylene/vinyl acetate binders by interpolymerization with the appropriate acrylate functionalities; however, this has also only been accomplished with a consequent reduction in the strength of the binder. As a result of this loss in strength, no more than 25% by weight acrylate functional has been employed in ethylene/vinyl acetate based binders for non-wovens.

SUMMARY OF THE INVENTION

We have now found that latex binders for use in forming nonwovens can be prepared by the emulsion polymerization of:

- 30 to 50% by weight of a vinyl ester of an alkanoic acid;
- 10 to 30% by weight ethylene;
- 30 to 50% by weight of a $C_4$–$C_8$ alkyl acrylate; and
- 1 to 5% by weight of copolymerizable N-methylol containing monomer;

wherein the polymerization is performed using batch or semi-batch emulsion polymerization techniques.

Surprisingly, nonwovens prepared with these binders possess the desirable softness characteristic of binders containing high acrylate content, with no reduction, indeed often with improvement, in the tensile strength properties.

As used herein, the term "batch" refers to a process whereby all the major monomers are charged to the reactor initially with the N-methylol containing monomer added uniformly and concurrently with the initiators. The term "semi-batch" refers to a process whereby the vinyl ester and ethylene are charged initially and the N-methylol containing monomer and acrylate components are pre-emulsified and added uniformly and concurrently with the initiators.

These processes are in contrast to conventional slow-addition processes used to prepare acrylate-containing binder emusions for nonwovens such as that disclosed in U.S. Pat. No. 4,044,197 wherein water, emulsifying agents and optionally a minor portion of the monomers are initially charged in the reactor and the monomers then added gradually with the initiators over the course of the reaction.

In a preferred embodiment of the invention, a small amount of an N-methylol containing thermoset polymer such as melamine formaldehyde condensate is post-added to the emulsion in an amount of 0.5 to 5%. When utilizing these thermosets, smaller amounts of the N-methylol containing monomer are required to achieve comparable strength. As an example, conventional binders for use in specific applications where wet strength is important require 2–5% N-methylol containing monomers such as N-methylol acrylamide (NMA); when thermosets are used comparable results may be obtained with only about 0.5–2% NMA. Since NMA increases the stiffness of the nonwoven, these lower NMA levels are advantageous because they provide comparable strength with a softer product than could be obtained at the higher levels.

By utilizing the emulsion polymerization procedures described herein, applicants have been able to obtain latex binders which, when used in the formation of nonwovens, give products characterized by a balance of softness and strength heretofore achievable only by use of thermal bonding techniques.

DESCRIPTION OF THE PREFERRED EMBODIMENTS

Figure 1:
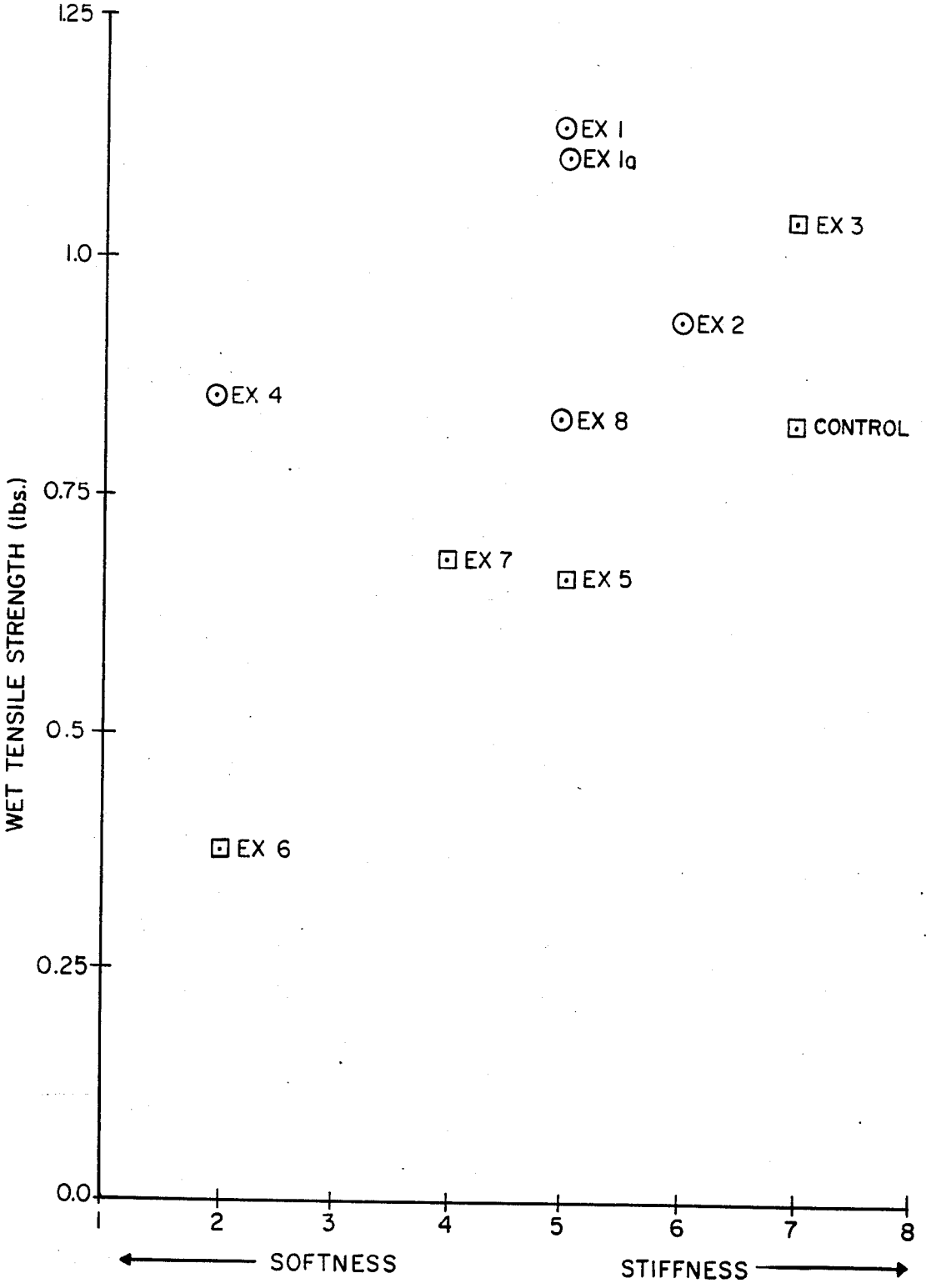
Figure 2:
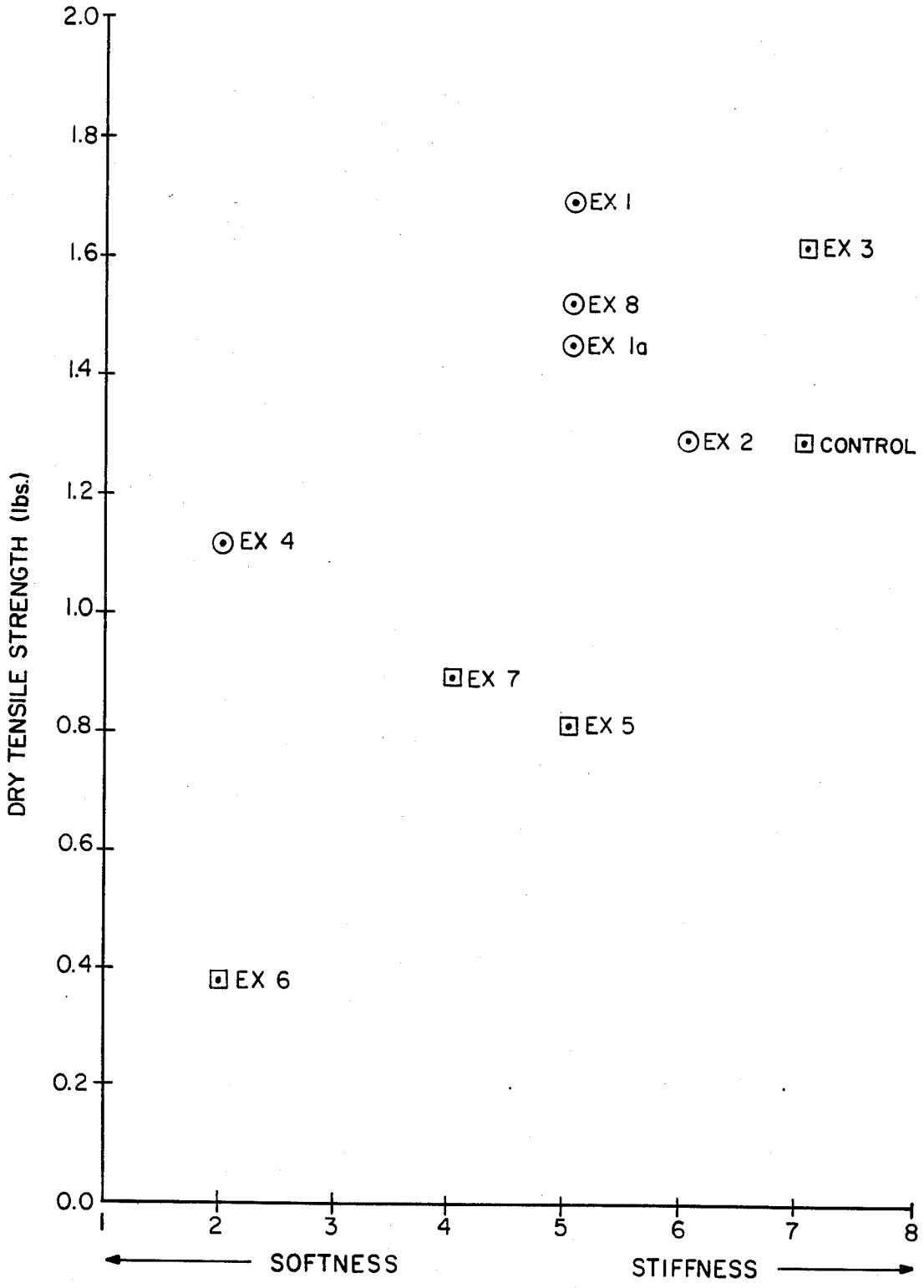

The vinyl esters utilized herein are the esters of alkanoic acids having from one to about 13 carbon atoms. Typical examples include: vinyl formate, vinyl acetate, vinyl propionate, vinyl butyrate, vinyl isobutyrate, vinyl valerate, vinyl 2-ethyl-hexanoate, vinyl isooctanoate, vinyl nonoate, vinyl decanoate, vinyl pivalate, vinyl versatate, etc. Of the foregoing, vinyl acetate is the preferred monomer because of its ready availability and low cost.

The N-methylol component is generally N-methylol acrylamide although other mono-olefinically unsaturated compounds containing an N-methylol group and capable of copolymerizing with ethylene and the vinyl ester may also be employed. Such other compounds include, for example, N-methylol methacrylamide or lower alkanol ethers thereof, or mixtures thereof.

The alkyl acrylates used herein are those containing 4 to 8 carbon atoms in the alkyl group and incude butyl, hexyl, 2-ethyl hexyl and octyl acrylate. The corresponding methacrylates may also be used herein.

Optionally, mono-ethylenically or polyethylenically unsaturated copolymerizable monomers known for use in free-radical initiated polymerizations may also be present in small amounts. In addition, certain copolymerizable monomers which assist in the stability of the copolymer emulsion, e.g., acrylamide and vinyl sulfonic acid, are also useful herein as latex stabilizers. These optionally present monomers, if employed, are added in very low amounts of from 0.1 to about 2% by weight of the monomer mixture.

In accordance with either the batch or semi-batch procedures utilized herein the vinyl acetate, ethylene, acrylate and the N-methylol containing monomer are polymerized in a aqueous medium under pressures not exceeding 100 atmospheres in the presence of a catalyst and at least one emulsifying agent, the aqueous system being maintained by a suitable buffering agent at a pH of 2 to 6, the catalyst being added incrementally or continuously. If a batch process is used, the vinyl acetate and the acrylate components are suspended in water and are thoroughly agitated in the presence of ethylene under the working pressure to effect solution of the ethylene in the vinyl acetate and acrylate up to the substantial limit of its solubility under the condition existing in the reacton zone, while the vinyl acetate and acrylate are gradually heated to polymerization temperature. The homogenization period is followed by a polymerization period during which the catalyst, which consists of a main catalyst or initiator, and may include an activator, is added incrementally or continuously together with the N-methylol containing monomer, the pressure in the system being maintained substantially constant by application of a constant ethylene pressure if required. The semi-batch process is similar but some or all of the acrylate component is pre-emulsified with the N-methylol containing monomer and then added incrementally or continuously as the polymerization proceeds.

Suitable as polymerization catalysts are the water-soluble free- radical-formers generally used in emulsion polymerization, such as hydrogen peroxide, sodium persulfate, potassium persulfate and ammonium persulfate, as well as tert-butyl hydroperoxide, in amounts of between 0.01 and 3% by weight, preferably 0.01 and 1% by weight based on the total amount of the emulsion. They can be used alone or together with reducing agents such as sodium formaldehyde-sulfoxylate, iron-II-salts, sodium dithionite, sodium hydrogen sulfite, sodium sulfite, sodium thiosulfate, as redox catalysts in amounts of 0.01 to 3% by weight, preferably 0.01 to 1% by weight, based on the total amount of the emulsion. The free-radical-formers can be charged in the aqueous emulsifier solution or be added during the polymerization in doses.

The polymerization is carried out at a pH of between 2 and 7, preferably between 3 and 5. In order to maintain the pH range, it may be useful to work in the presence of customary buffer systems, for example, in the presence of alkali metal acetates, alkali metal carbonates, alkai metal phosphates. Polymerization regulators, like mercaptans, aldehydes, chloroform, methylene chloride and trichloroethylene, can also be added in some cases.

The dispersing agents are all the emulsifiers generally used in emulsion polymerization, as well as optionally present protective colloids. It is also possible to use emulsifiers alone or in mixtures with protective colloids.

The emulsifiers can be anionic, cationic or non-ionic surface-active compounds. Suitable anionic emulsifiers are, for example, alkyl sulfonates, alkylaryl sulfonates, alkyl sulfates, sulfates of hydroxyalkanols, alkyl and alkylaryl disulfonates, sulfonated fatty acids, sulfates and phosphates of polyethoxylated alkanols and alkylphenols, as well as esters of sulfosuccinic acid. Suitable cationic emulsifiers are, for example, alkyl quaternary ammonium salts, and alkyl quaternary phosphonium salts. Examples of suitable non-ionic emulsifiers are the addition products of 5 to 50 mols of ethylene oxide adducted to straight-chained and branch-chained alkanols with 6 to 22 carbon atoms, or alkylphenols, or higher fatty acids, or higher fatty acid amides, or primary and secondary higher alkyl amines; as well as block copolymers of propylene oxide with ethylene oxide and mixtures thereof. Preferably nonionic and/or anionic emulsifiers are used as emulsifying agents in amounts of 1 to 6% by weight of the polymerisate.

Suitable protective colloids optionally employed are partially or completely saponified polyvinyl alcohol with degrees of hydrolysis between 75 and 100% and viscosities of between 3 and 48 cps, measured as a 4% aqueous solution at 20° C.; water-soluble cellulose ether derivatives, like hydroxyethyl cellulose; hydroxypropyl cellulose, methylcellulose or carboxymethyl cellulose; water-soluble starch ethers; polyacrylic acid or water-soluble polyacrylic acid copolymers with acrylamide and/or alkyl acrylates; poly-N-vinyl compounds of open-chained or cyclic carboxylic acid amides; and mixtures thereof.

The copolymers according to the invention have a glass transition temperture of between −45° to −20° C. and dry to form soft flexible films. They are generally crosslinked in a weakly acid pH range or in the presence of latent acid catalysts at elevated temperature. The optimum crosslinking temperatures are between 100° and 200° C., preferably between 130° and 160° C. Acid catalysts accelerate the crosslinking. Such acid catalysts are mineral acids or organic acids, such as phosphoric acid, tartaric acid, citric acid, or acid salts, such as chromium -III salts, aluminum chloride, ammonium chloride, zinc nitrate or magnesium chloride.

The process of making the vinyl acetate-ethylene-acrylate-N-methylol containing interpolymer latices generally comprises the preparation of an aqueous solution containing at least some of the emulsifying agent and stabilizer, and the pH buffering system. This aqueous solution and the initial charge of vinyl acetate are added to the polymerization vessel and ethylene pressure is applied to the desired value. The quantity of ethylene entering into the copolymer is influenced by the pressure, the agitation, and the viscosity of the polymerization medium. Thus, to increase the ethylene content of the copolymer, higher pressures are employed. A pressure of at least about 10 atmospheres is most suitably employed. As previously mentioned, the mixture is thoroughly agitated to dissolve the ethylene, agitation being continued until substantial equilbrium is achieved. This generally requires about 15 minutes. However, less time may be required depending upon the vessel, the efficiency of agitation, the specific system, and the like. When high ethylene contents are desired, a higher degree of agitation should be employed. In any case, by measuring the pressure drop of the ethylene in conventional manner, the realization of substantial equilibrium can be easily determined. Conveniently the charge is brought to polymerization temperature during this agitation period. Agitation can be effected by shaking, by means of an agitator, or other known mechanism. The polymerization is then initiated by introducing initial amouts of the catalyst, and of the activator when used. After polymerization has started, the catalyst and the activator are incrementally added as required to continue polymerization, and the N-methylol containing monomer and in the case of the semi-batch process, the acrylates are similarly added.

As mentioned, the reaction is generally continued until the residual vinyl acetate, acrylate and N-methylol monomer content is below about 1%. The completed reaction product is then allowed to cool to about room temperature, while sealed from the atmosphere.

By following the procedure described above, particularly the initial saturation of the polymerization mixture with ethylene before polymerization is initiated, there can be produced the stable vinyl acetate-ethylene-acrylate-N-methylol containing interpolymer latex characterized above, with the copolymer having an ethylene content of 10 to 30%, an intrinsic viscosity of 1 to 2.5 dl./g. (measured in dimethyl formamide) and an average particle size of 0.1 to 2 microns, with the latex having a high solids content of up to 60% or more.

The vinyl acetate-ethylene-acrylate-N-methylol containing binder described above is suitably used to prepare nonwoven fabrics by a variety of methods known to the art which in general, involve the impregnation of a loosely assembled web of fibers with the binder latex, followed by moderate heating to dry the web. In the case of the present invention this moderate heating also serves to cure the binder, that is, by forming a cross-linked interpolymer. Before the binder is applied it is optionally mixed with a suitable catalyst for the N-methylol groups present as comonomer and thermoset. Thus, acid catalysts such as mineral acids, e.g. HCl, or organic acids, e.g., oxalic acid, or acid salts such as ammonium chloride, are suitably used, as known in the art. The amount of catalyst is generally about 0.5 to 2% of the total resin.

As discussed previously, it may also be desirable to improve the strength of the monomer using such lower levels of the N-methylol containing monomers as will provide for extremely soft materials. This may be accomplished by replacing 0.5 to 5% by weight of the latex binder solids with an N-methylol containing thermoset polymer. Suitable polymers are represented by the following formula

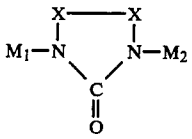

(I)

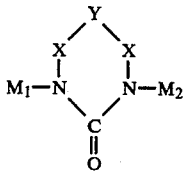

(II)

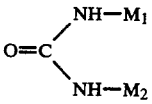

(III)

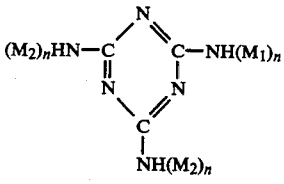

(IV)

wherein (a) X is $>CH_2$ or $>CHOH$;

(b) X—X can be

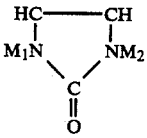

(c) Y is $>CH_2$ or $RN<$ wherein R is lower alkyl or hydroxy lower lower alkyl:

(d) $M_1$ is—$CH_2OH$;

(e) each of $M_2$ and $M_3$ is H or a —$CH_2OR^1$ group wherein $R^1$ is a lower alkyl group and n is 1 or 2.

Typical examples of these thermoset polymers are monoethylolmelamine, dimethylolmelamine, trimethylolmelamine, tetramethylolmelamine, pentamethylolmelamine, hexamethylolmelamine, N-methoxymethyl N'-methylolmelamine, dimethylolethylene urea, monomethylol urea, dimethylol urea, dimethylolethyltriazone, dimethylolhydroxyethyltriazone, tetramethylolacetylene diurea, dimethylolpropylene urea, dimethyloldihydroxyethylene urea, N-butoxymethyl N-methylol urea and N-methymethyl N-methylol urea.

Additionally there may also be present in the latex binders other additives conventionally employed in similar binders including defoamers, pigments, catalysts, wetting agents, thickeners, external plasticizers, etc. The choice of materials as well as the amounts employed are well known to those skilled in the art. These materials may be added just before application, if their stability in the dispersion or solution is low, or they may be formulated into the aqueous dispersion of the binder and stored if the stability in aqueous dispersion is high.

The starting fibrous web can be formed by any one of the conventional techniques for depositing or arranging fibers in a web or layer. These techniques incude carding, garnetting, air-laying, and the like. Individual webs or thin layers formed by one or more of these techniques can also be lapped or laminated to provide a thicker layer for conversion into a heavier fabric. In general, the fibers extend in a plurality of diverse directions in general alignment with the major plane of the fabric, overlapping, intersecting and supporting one another to form an open, porous structure. When reference is made to "cellulose" fibers, those fibers containing predominately $C_6H_{10}O_5$ groupings are meant. Thus, examples of the fibers to be used in the starting web are the natural cellulose fibers such as wood pulp, and chemically modified celluloses such as regenerated cellulose. Often the fibrous starting web contains at least 50% cellulose fibers, whether they be natural or synthetic, or a combination thereof. Other fibers in the starting web may comprise natural fibers such as wool; artificial fibers such as cellulose acetate; synethetic fibers such as polyamides, i.e., nylon, polyesters, i.e., "Dacron", acrylics, i.e., "Dynel," "Acrilan," "Orlon," polyolefins, i.e., polyethylene, polyvinyl chloride, polyurethane, etc., alone or in combination with one another.

The fibrous starting layer or web suitably weighs from about 5 to 65 grams per square yard and generally weighs about 10 to 40 grams per square yard. This fibrous starting layer, regardless of its method of preparation, is then subjected to at least one of the several types of latex bonding operations to anchor the individual fibers together to form a self-sustaining web. Some of the better-known methods of bonding are overall impregnation, spraying or printing the web with intermittent or continuous straight or wavy lines or areas of binder extending generally transversely or diagonally across the web additionally, if desired, along the web.

The amount of binder, calculated on a dry basis, applied to the fibrous starting web suitably ranges from about 10 to about 100 parts or more per 100 parts of the starting web, and preferably from about 20 to about 45 per 100 parts of the starting web. The impregnated web is then dried and cured. Thus, the fabrics are suitably dried by passing them through an air oven or over a series of heated cans or the like and then through a curing oven or sections of hot cans. Ordinarily, convection air drying is effected at 65°-95° C. for 2-6 min., followed by curing at 145°-155° C. for 1-5 min. or more. However, other time-temperature relationships can be employed, as is well known in the art, shorter times at higher temperatures or longer times at lower temperatures being used. For example, the curing step can be carried out at about 135° C. for about 15 minutes or more in a laboratory or pilot line but may require only 2 to 20 seconds on high pressure high efficiency steam cans used in high speed production. If desired, the drying and curing can be effected in a single exposure or step.

Nonwoven fabrics prepared in accordance with this invention have greater strength than other resin bonded nonwovens of comparable softness levels and, as such, are competitive with woven fabrics and thermally bonded polyolefins.

The following examples are given to illustrate the present invention, but it will be understood that they are intended to be illustrative only and not limitative of the invention. In the examples, all parts are by weight unless otherwise indicated. The procedures utilized to prepare the binders produced in the examples are as follows:

EXAMPLE 1

A 10 liter stainless steel autoclave equipped with heating/cooling means, variable rate stirrer and means of metering monomers and initiators was employed. To the 10 liter autoclave was charged 450 g (of a 20% w/w solution) sodium alkyl aryl polyethylene oxide sulphate (3 moles ethylene oxide), 40 g (of a 70% w/w solution in water) alkyl aryl polyethylene oxide (30 mole ethylene oxide), 90 g (of a 25% w/w solution in water) sodium vinyl sulphonate, 2 g sodium formaldehyde sulphoxylate, 0.5 g sodium acetate, 5 g (of a 1% solution in water) ferrous sulphate solution and 2500 g water. After purging with nitrogen all the vinyl acetate (2000 g) was added and the reactor was pressurized to 750 psi with ethylene and equilibrated at 50° C. for 15 minutes.

The polymerization was started by metering in a solution of 25 g. tertiary butyl hydroperoxide in 250 g of water and 25 g sodium formaldehyde sulphoxylate in 250 g of water. The initiators were added at a uniform rate over a period of 5¼ hours.

Concurrently added with the initiators over a period of 4 hrs was a pre-emulsified blend of 2000 g butyl acrylate and 150 g N-methylol acrylamide (48% w/w solution in water) in a solution of 450 g (of a 20% w/w solution in water) sodium alkyl aryl polyethylene oxide sulphate (3 mole ethylene oxide), 25 g (of a 70% w/w solution in water) alkyl aryl polyethylene oxide (30 mole ethylene oxide) and 1 g sodium acetate in 400 g water.

During the polymerization, the temperature of the reaction was maintained at 55°–60° C. by means of cooling and at the end of the reaction, the emulsion was transferred to an evacuated vessel (30 liter) to remove residual ethylene from the system. Composition and analysis of the latex is given in Table 1.

In Example 1*a*, the same procedure was repeated using a higher level (about 500 g) of N-methylolacrylamide.

EXAMPLE 2

The procedure was as in Example 1, except that the vinyl acetate charge was 2400 g instead of 2000 g and the butyl acrylate was 1600 g.

EXAMPLE 3

The procedure was as in Example 1, except that 2800 g of vinyl acetate and 1200 g of butyl acrylate were used.

EXAMPLE 4

The procedure was as in Example 1, except that 2800 g. of vinyl acetate and 1200 g of 2-ethylhexyl acrylate were used.

COMPARISON EXAMPLE 5

The following three examples utilize the slow addition technique typically used to prepare the vinyl acetate, ethylene, acrylate nonwoven binders of the prior art.

To the 10 liter autoclave was charged 90 g (of a 20% w/w solution in water sodium alkyl aryl polyethylene oxide sulphate (3 moles ethylene oxide), 6 g (of a 70% w/w solution in water) alkyl aryl polyethylene oxide (30 mole ethylene oxide), 20 g (of a 25% w/w solution sodium vinyl sulphonate, 2 g sodium formaldehyde sulphoxylate 0.5 g sodium acetate, 5 g (of a 1% w/w solution in water) ferrous sulphate solution and 2000 g water. After purging with nitrogen, 300 g vinyl acetate and 100 g butyl acrylate were charged to the reactor. The reactor was then pressurized to 750 psi with ethylene and equilibrated at 50° C. for 15 minutes. The polymerization was started by metering in a solution of 35 g tertiary butyl hydroperoxide in 250 g water and 35 g sodium formaldehyde sulphoxylate in 250 g water over a period of 6½ hours.

Concurrently added with the initiators over a period of 4 hrs was a pre-emulsified blend of 1900 g butyl acrylate, 1700 g. vinyl acetate, 150 g (48% w/w solution in water) N-methylol acrylamide, 810 g (of a 20% w/w solution in water) sodium alkyl aryl polyethylene oxide sulphate (3 mole ethylene oxide), 60 g (of a 70% w/w solution in water) alkyl aryl polyethylene oxide (30 mole ethylene oxide), 1 g sodium acetate, 60 g (of a 25% w/w solution in water) sodium vinyl sulphonate in 600 g water.

During the polymerization, the temperature of the reaction was maintained at 55–60° C. by means of cooling and the pressure at 750 psi of ethylene by adding it when necessary. At the end of the additions of monomers and catalysts, the emulsion was transferred to an evacuated vessel following the procedure in Ex 1.

COMPARISON EXAMPLE 6

The procedure was as in Example 5, except that ethylene was omitted from the polymerization and the initial charge was 40 g butyl acrylate and 160 g vinyl acetate. The pre-emulsified monomer charge was also changed with the vinyl acetate being 860 g and the butyl acrylate being 2960 g.

COMPARISON EXAMPLE 7

The procedure was as in Example 5, except that ethylene was omitted from the polymerization and the initial charge was 40 g butyl acrylate and 160 g vinyl acetate. The pre-emulsified monomer charge was also changed with the vinyl acetate being 1240 g and the butyl acrylate being 2560 g.

EXAMPLE 8

This example illustrates the use of the batch polymerization process in preparing nonwoven binders of the present invention.

To the 10 liter autoclave was charged 675 g (of a 20% w/w solution in water) sodium alkyl aryl polyethylene oxide sulphate (3 moles ethylene oxide), 50 g (of a 70% w/w solution in water) alkyl aryl polyethylene oxide (30 moles ethylene oxide), 60 g (of a 25% w/w solution in water) sodium vinyl suphonate, 0.5 g sodium acetate, 2 g sodium formaldehyde sulphoxylate, 5 g (of a 1% w/w solution in water) ferrous sulphate solution and 2000 g water. After purging with nitrogen, 1500 g vinyl acetate and 1500 g butyl acrylate were charged to the reactor. The reactor was then pressurized to 650 psi with ethylene and equilibrated at 50° C. for 15 minutes. The polymerization was then started by metering in a solution of 12 g tertiary butyl hydroperoxide in 225 g water and 10 g sodium formaldehyde sulphoxylate in 225 g water over a period of 6 hrs. uniformly.

Concurrently added with the initiators over a period of 4 hrs. was 110 g N-methylol-acrylamide (48% w/w solution in water) in 370 g water.

During the polymerization, the temperature of the reaction was maintained at 55°-60° C. by means of cooling. At the end of the initiator slow additions, the product was transferred to an evacuated vessel (30 liter) to remove residual ethylene from the system.

The results obtained by testing the binders of Examples 1-8 are shown in Table 1 and are compared with a commercially employed vinyl acetate/ethylene/N-methylol acrylamide polymer (designated CONTROL). In the Table, the abbreviations SB, SA and B are used to represent semi-batch, slow addition and batch polymerization techniques respectively. The results are also graphed and provided as FIGS. I and II where FIG. I shows the relation between dry tensile strength and softness, and FIG. II a similar relationship using wet tensile strength values. In the graphs, the points designated by a circle indicate those nonwovens falling within the scope of the claims, while the points designated by a square represent control or comparative compositions.

In preparing samples for testing, lengths of 15 gram per square yard polyester were saturated using a Butterworth Padder and a bath of 100 parts dry binder, 2 parts surfactant, 1 part catalyst, 2 parts melamine formaldehyde thermoset and sufficient water to give a 25% solids dilution, with a dry pick up of approximately 40 to 45 parts binder per 100 parts polyester web. The saturated web was dried for 2 minutes at 145° C. in a laboratory contact drier.

The tensile tests were run on a standard Instron tester set at 3 inch gauge length and 5 inch crosshead speed. The wet tensile was run after soaking specimens one minute in a 0.5% solution of Aerosol OT wetting agent. Results shown reflects the average of 10 tests.

The softness or hand of a nonwoven is difficult to test using quantitative techniques. There is a correlation between softness of the nonwoven and Tg of the binder system, however since Tg is the temperature at which the polymer changes from a glassy to a rubbery state (which for soft nonwoven binder is generally in the range of −20° C. to −35° C. or lower), neither measured Tg nor calculated Tg is a completely adequate measure of the perceived softness of a binder at ambient conditions. Nonetheless, for binders using the same class of comonomers for example, vinyl acrylic binders, ethylene-vinyl acetate binders, etc, the lower the Tg of the copolymer, the greater the softness of the nonwoven made therewith.

In the case of the nonwoven samples tested herein, a panel test was also run to determine the relative softness by rating the samples in order of softest to firmest by feeling the drape and pliability of the samples. The softest sample was rated as 1, the next a 2, etc., for the total numbers tested. The results reported show the average of five panelist ratings for each sample.

As shown in the Table, binders produced utilizing the batch process (Example 8) as well as the semi-batch process (Examples 1-*a*, 2 and 4) exhibit a good balance of strength vs. hand (softness) as opposed to the slow addition processes of Examples 5, 6 and 7.

More specifically, the benefits of the present invention with with respect to maximizing the balance of the contradictory properties of softness and strength will be recognized from an analysis of Table I in conjunction with the graphs of FIGS. I and II. Comparisons may be made along either axis with the understanding that at equal strengths, the preferred binder is that which gives the softest nonwoven and at equal softness levels, preference is given to the strongest binder.

Thus Examples 1 and 8 show binder compositions having an optimum level of softness and strength achieved using the batch or semi-batch process required by the invention. When these properties are compared with those obtained from the same polymer composition prepared in Example 5, it is seen that the increased level of acrylate when incorporated using the slow addition techniques used in prior art nonwoven binder preparations, while softening the hand, substantially reduces the wet and dry tensile strengths.

A comparison of the results of Example 4 of the invention with Comparative Example 6, shows that an equal level of softness can be achieved using very high levels of butyl acrylate with the slow addition process and using substantially less 2-ethyl hexyl acrylate with the semi-batch process. Note however, that the slow addition process, while producing the "softest" product also produces they weakest binder. In contrast, the binder of Example 4 gives high wet and dry tensile strength values.

A comparison of Examples 1, 2,and 4 as opposed to Example 3 show that at least about 30% of the acrylate monomer is required to obtain adequate softness for use as a binder in very soft most nonwoven applications. Example 2 and 4 illustrate the differences in softness achieved using the same amount of different acrylate monomers.

The control represents the "softest" product that can be obtained using the ethylene, vinYl acetate, NMA binders of the prior art. This composition contains 35 parts ethylene (the highest amount of ethylene that can be generally be incorporated using standard techniques of emulsion polymerization). The binder, while providing adequate strength is too stiff for many nonwoven applications such as for disposable diapers made by thermal bonding. On the other hand, the vinyl acrylic binders of Examples 6 and 7, while being soft enough for these applications, are unacceptably deficient in wet and dry strength properties.

It will be apparent that various changes and modifications may be made in the embodiments of the invention described above, without departing from the scope of the invention, as defined in the appended claims, and it is intended therefore, that all matter contained in the foregoing description shall be interpreted as illustrative only and not as limitative of the invention.

TABLE 1

| EXAMPLE | MONOMER COMPOSITION (%) BA | VA | 2EHA | E | NMA | PROCESS TYPE | TENSILE STRENGTH DRY (lbs./inch) | WET (lbs./inch) | HAND (1 = SOFT 7 = HARD) |
|---|---|---|---|---|---|---|---|---|---|
| 1 | 40 | 40 | — | 20 | 1.5 | SB | 1.71 | 1.13 | 5 |
| 1a | 40 | 40 | — | 20 | 5.0* | SB | 1.46 | 1.09 | 5 |
| 2 | 32 | 48 | — | 20 | 1.5 | SB | 1.30 | 0.93 | 6 |
| 3 | 24 | 56 | — | 20 | 1.5 | SB | 1.63 | 1.04 | 7 |
| 4 | — | 48 | 32 | 20 | 1.5 | SB | 1.12 | 0.85 | 2 |
| 5 | 40 | 40 | — | 20 | 1.5 | SA | 0.82 | 0.66 | 5 |
| 6 | 75 | 25 | — | — | 1.5 | SA | 0.38 | 0.37 | 2 |
| 7 | 65 | 35 | — | — | 1.5 | SA | 0.90 | 0.68 | 4 |
| 8 | 40 | 40 | — | 20 | 1.5 | B | 1.53 | 0.83 | 5 |
| Control | — | 65 | — | 35 | 4.5 | SA | 1.31 | 0.83 | 7 |

*No melamine formaldehyde thermoset was utilized in this formulation.

We claim:

1. An aqueous emulsion adapted for producing nonwovens, said emulsion being prepared by the emulsion polymerization of:

(a) 30 to 50% by weight of a vinyl ester of an alkanoic acid;

(b) 10 to 30% by weight ethylene;

(c) 30 to 50% by weight of a $C_4$–$C_8$ alkyl acrylate; and (d) 1 to 5% by weight of copolymerizable N-methylol containing monomer; wherein the polymerization is performed using batch or semi-batch emulsion polymerization techniques.

2. The aqueous emulsion of claim 1 wherein the vinyl ester is vinyl acetate.

3. The aqueous emulsion of claim 1 wherein the N-methylol containing monomer of claim 1 is N-methyolacrylamide.

4. The aqueous emulsion of claim 1 wherein the alkyl acrylate is butyl acrylate or 2-ethylhexyl acrylate.

5. The aqueous emulsion of claim 1 wherein the emulsion is prepared using semi-batch emulsion polymerization techniques.

6. The aqueous emulsion of claim 1 additionally containing 0.5 to 5% by weight of an N-methylol containing thermoset polymer.

7. The aqueous emulsion of claim 6 wherein the copolymerizable N-methylol containing monomer is present in an amount of 1 to 2.5% by weight.

8. The aqueous emulsion of claim 6 wherein the N-methylol containing thermoset polymer is a melamine formaldehyde condensate.

9. A nonwoven fabric formed from a loosely assembled web of fibers bonded together with an aqueous emulsion; said aqueous emulsion being prepared by the emulsion polymerization of:

(a) 30 to 50% by weight of a vinyl ester of an alkanoic acid;

(b) 10 to 30% by weight ethylene;

(c) 30 to 50% by weight of a $C_4$–$C_8$ alkyl acrylate; and (d) 1 to 5% by weight of copolymerizable N-methylol containing monomer; wherein the polymerization is performed using batch or semi-batch emulsion polymerization techniques.

10. The nonwoven fabric of claim 9 comprising a loosely assembled web of hydrophoic fibers for use as a facing in disposable constructions.

11. The nonwoven fabric of claim 10 wherein the binder is present in an amount of 20 to 45 parts dry weight per 100 parts fiber.

12. The nonwoven faric of claim 10 herein the N-methylol containing polyer is a melamine formaldehyde condensate.

13. The nonwoven fabrice of claim 9 wherein the aqueous emulsion comprises vinyl acetate, ethylene, butyl acrylate or 2-ethyl hexyl acrylate and N-methylol acrylamide.

14. The nonwoven fabric of claim 9 wherein there is additionally present in the aqueous emulsion 0.5 to 5% by weight of an N-methylol containing thermoset polymer.

15. The nonwoven fabric of claim 14 comprising a loosely assembled web of hydrophobic films for use as a facing in disposable constructions.

16. A process for forming a nonwoven fabric from a loosely assembled mass of fibers comprising of steps of:

(i) bonding the fibers with an aqueous emulsion binder said binder prepared by the emulsion polymerization of:

(a) 30 to 50% by weight of a vinyl ester of an alkanoic acid;

(b) 10 to 30% by weight ethylene;

(c) 30 to 50% by weight of a $C_4$–$C_8$ alkyl acrylate; and (d) 1 to 5% by weight of copolymerizable N-methylol containing monomer; wherein the polymerization is preformed using batch or semi-batch emulsion polymerization techniques; and (ii) heating to remove the water and cure the binder.

17. The process of claim 16 wherein the binder is prepared using a semibatch polymerization procedure.

18. The process of claim 16 wherein the vinyl ester is vinyl acetate; the copolymerizable methylol containing monomer is N-methylol acrylamide and the alkyl acrylate is butyl acrylate or 2-ethyhexyl acrylate.

19. The process of claim 16 wherein the curing is affected utilizing an acid catalyst.

20. The process of claim 16 wherein there is additionally present in the aqueous emulsion 0.5 to 5% by weight of an N-methylol containing thermoset polymer.

* * * * *